United States Patent [19]

Bartenbach et al.

[11] Patent Number: 4,717,992

[45] Date of Patent: Jan. 5, 1988

[54] LUMINAIRE WITH A RODLIKE LAMP AND LAMELLA SEGMENT THEREFORE

[75] Inventors: Christian Bartenbach, Munich, Fed. Rep. of Germany; Torkild Thage-Jorgensen, Nivå , Denmark

[73] Assignee: Solar Armaturproduktion A/S, Vejen, Denmark

[21] Appl. No.: 798,069

[22] PCT Filed: Dec. 21, 1984

[86] PCT No.: PCT/DK84/00122

§ 371 Date: Dec. 17, 1985

§ 102(e) Date: Dec. 17, 1985

[87] PCT Pub. No.: WO85/03760

PCT Pub. Date: Aug. 29, 1985

[30] Foreign Application Priority Data

Feb. 22, 1984 [DE] Fed. Rep. of Germany ..... 3406447

[51] Int. Cl.[4] ..... F21V 7/00

[52] U.S. Cl. ..... 362/217; 362/255; 362/290; 362/342

[58] Field of Search ..... 362/217, 255, 256, 260, 362/257, 223, 206, 207, 341, 346, 347

[56] References Cited

U.S. PATENT DOCUMENTS

| | | | |
|---|---|---|---|
| 2,319,572 | 5/1943 | Wilson | 362/217 |
| 2,429,141 | 10/1947 | Taylor | 362/217 |
| 2,537,398 | 1/1951 | Dameral | 362/217 |
| 4,539,628 | 9/1985 | Bartenbach | 362/217 |

FOREIGN PATENT DOCUMENTS

| | | | |
|---|---|---|---|
| 171616 | 12/1951 | Fed. Rep. of Germany | 362/217 |
| 1312498 | 11/1962 | France | 362/223 |

*Primary Examiner*—William A. Cuchlinski, Jr.
*Assistant Examiner*—D. M. Cox
*Attorney, Agent, or Firm*—Thomas R. Vigil

[57] ABSTRACT

With the purpose of obtaining an axial angle of cut off for a luminaire with a rodlike lamp (1) a glare protection is arranged comprising lamellas (2), the lamellas being arranged immediately at or around the surface of the lamp to form axially spaced and radially outward from the surface extending effective surfaces.

14 Claims, 10 Drawing Figures

LUMINAIRE WITH A RODLIKE LAMP AND LAMELLA SEGMENT THEREFORE

Figure 1:
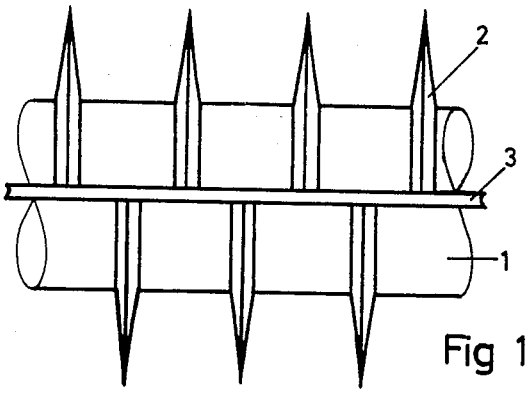

The present invention concerns a luminaire with a rodlike lamp and moreover of the type described in the initial phrases of the appended claim 1 and a lamellar segment for use in such a luminaire.

Because a rodlike lamp emits light not only in all radial directions but also in axial direction it is aimed to design luminaries in such a way that the light radiated is deflected under maximum utilization and in such a way as to obtain illumination of interiors, workstations and the like with as little glare as possible.

To deflect the radially emitted light a longitudinally extending reflector is arranged parallel to the lamp and on that side of the lamp which is opposite to the area to be illuminated. However, such a reflector also reflects the axially emitted light without directing this in the direction desired.

Therefore it has up till now been customary to arrange a lamellar louver at the light output side of the luminaire.

One drawback of such arrangements is that the lamellas themselves influence the reflected radiation causing mislead radiation at the topsides of the lamellas.

To avoid this the topsides of the lamellas have been blackened which, however, causes a loss of light. Complicated lamellas designed for an improved directing of the radiation have also been employed but these have been costly in production.

One common drawback for all these arrangements is the considerable constructional height of the luminaire which is caused by the arranging of lamellas at the light output side for which reason the lamella arrangements have been left out entirely in cases where a reduced constructional height or a simple construction was a must.

It is the aim of the invention starting from this state of art to provide a simple protection against longitudinal glare for a luminaire with a rodlike lamp that can be manufactured at low cost and can replace the formerly used, complicated, costly in production and bulky lamella arrangements; further the glare protection is aimed to be to a large extent independent of the construction of the luminaire making it possible to provide even very flat luminaires with the longitudinal glare protection.

This is achieved with the distinctive features listed in the characterizing part of the appended claim 1. Thus the lamellas according to the invention are not arranged at a distance in front of the lamp at the lightoutput side as being the case in the prior art. On the contrary the lamellas are arranged adjacent to and around the surface of the lamp making it possible to reduce the constructional height for the luminaire as a whole.

The lamellas may be mounted around the lamp suspended in their own carrier devices. However, according to one embodiment of the invention the lamellas are carried by the lamp itself, the lamellas surrounding the lamp at virtually no distance and substantially in the circumferential direction.

The lamellas themselves are reflective, e.g., with reflective coating. The lamellas reflect the light emitted according to the reflective coating which may be mat or lustrous essentially without loss and without being translucent to the light to any substantial degree.

The distance between and the radial height of the lamellas are adapted to ensure that a light beam emitted from the lamp in an axial plane at the base of a lamella close to the surface of the lamp and passing just over the top of the outer edge of an adjacent lamella has just an acceptable angular direction relative to the longitudinal axis of the lamp.

Because of the arrangement of the lamellas immediately at or on the lamp any other form of lamella arrangement placed at the luminaire is rendered superfluous and thus it is sufficient to provide the luminaire with a usual reflector to deflect the radially emitted radiation.

The lamellas as such are preferably manufactured from a low cost and easily manufacture plastic material making it feasible to renew the lamella arrangement according to the invention at the occasion of replacing a burned out lamp replacing completely the formerly necessary difficult and costly cleaning of lamella arrangements.

The lamellas may extend around the total circumference of the lamp but the lamellas may also be designed to extend in full height only along a part of the circumference in case the lamp is to be mounted close to the lamp housing which may often be the case in soffit lighting.

In one embodiment of the invention the lamellas may consist of individual lamellas embracing the lamp entirely or partly. These annular discs may be slid axially onto the lamp before it is mounted and on a horizontally installed lamp the annular discs may be slid loosely into position whereafter they remain in their positions. It is, however, also possible to apply onto the annular discs onto their circular cylindrical surface of contact a duroplastic adhesive to be activated by the heat from the lamp. It is also possible to make annular discs from an elastic resilient material such as a suitable plastic material with a more or less wide slot enabling the annular discs to be pressed or snapped radially onto the lamp. In this way it is possible to provide a lamp already installed with the glare protection according to this invention without removing the lamp.

Since as it has been mentioned above it is the spacing between the annular discs in connection with their radial height that directly determine the axial angle of light emittance, a maximum limit of the spacing between the annular discs should not be exceeded. On the other hand this maximum permissible distance should also be utilized to the highest possible extent to keep losses of illuminance and expense of material at a minimum.

To maintain the optimum spacing while making the fitting of the glare protection as easy as possible it is suggested according to this invention to interconnect the annular discs by means of an attached longitudinally extending connecting member. Such a connecting member may have notches catching or snapping the annular discs and thereby defining the spacing between these annular discs.

Such a longitudinally extending connecting member is preferably designed to keep its axially extending parts away from the lamp surface by the highest possible radial spacing to present the minimum obstacle to the radiance of light. It is possible to arrange the connecting member on the lower side of the lamp. In this case the connecting member may extend close to the surface of the lamp and in this way it also serves as a glare protection.

It is possible initially to place the annular discs onto the lamp and thereafter to apply the connecting member. However, it is preferred in advance to have the connecting member fitted onto, snapped onto, welded onto or glued onto the annular discs to provide a tube-like lamella structure that quickly and simply can be slid onto the lamp before it is mounted or fitted.

According to another embodiment of the invention a similar lamella construction may also be manufactured in one piece the lamellas hereby being constituted by half annular discs, the two halves of one annular disc being staggered axially to simplify the manufacturing. In this context the ends of the semi annular discs may be formed integrally with two opposite and axially extending connecting members, however one of these two connecting members could also be omitted in which case the ends of the semi annular discs opposite the connecting member could overlap seen in the axial direction. In the first case it is possible to manufacture the glare protection from a rigid material and then slide the glare protection onto the dismantled lamp. In the second case it is possible to manufacture the glare protection from a relatively resilient material making it possible also to press the glare protection onto a lamp being already mounted.

According to an alternative embodiment of the invention it may also be advantageous to provide the lamp with at least one surrounding helical lamella forming a cylindrical helix rather than several separate annular discs. Such a helix can be made from a relatively stiff material and needs after cutting out to a suitable length only to be slid over the dismounted lamp. It is, however, also possible and in respect to a simple and non-damaging packing and shipment further advantageous to make the helically formed glare protection from a highly resilient material. The turns of the helically formed glare protection will in the un-mounted state lie adjacent to each other, but after the cutting and fitting around the lamp the turns are pulled apart and the ends are fixed at the ends of the lamp either by pressing the ends into the sockets for the ends of the lamp or by a suitable ring on the lamp socket.

According to a further embodiment of the invention the lamellas as seen in a cross section along an axial plane have a profile or contour outwardly converging into a wedge-shape and preferably with concave flanks, the curvature of which is in the shape of a parabola or a hereto approximated circular arc. Preferably the contour extends outwards into the tip of lambella at an almost right angle making this tip in the form of a concave cutter with a very narrow cutting angle. By this configuration an even better distribution of light is obtained.

The glare protector according to the invention can be manufactured and composed of individual parts but may also be manufactured to correspond to the length of the various luminaires. Further the glare protector can be manufactured as an endless product to simplify the manufacture further as in this case any necessary length can be cut from a single supply string. In case longitudinally extending connecting members are provided these should be flexible to make it possible to roll up this string.

According to the invention several interconnected lamellas may also be in the form of independent glare protection bodies being interconnectable in a row or just abut on each other. Such glare protection bodies can be manufactured from a rigid material and then put together to fit any length of lamp. Thus it is for a given lamp diameter only necessary to keep a single configuration of glare protection body to meet any practically occurring demands of installation.

The individual glare protection bodies may advantageously by their ends have holding or catching devices to ensure that consecutive glare protection bodies at any time are fixed in the same direction. It is also possible to make these catching devices in the form of a snaplock making it possible from a given number of such glare protection bodies and in a separate operation during the fitting of a luminaire to manufacture a glare protection of suitable size which later only has to be slid onto the lamp.

As it has been mentioned a bright coloured plastic material with sufficient heat resistance and a lustrous reflecting surface is advantageous and well suited for the manufacture of the glare protection according to the invention. However, such a glare protection may also be provided with a metallic reflective coating.

The lamella arrangement according to the invention may also and in particular in connection with a rodlike lamp having a very high thermal output be made from metal which will also improve the cooling of the lamp. The luminaire according to the invention can in this way also be in the form of e.g. a halogene projector luminaire.

The invention further concerns a separate lamella segment for use in making up a glare protection for a luminaire according to the invention. Such a lamella segment generally comprises a plate or disc like reflector body, preferably with a circular outer circumference and with a central orifice for receiving or locating the rodlike lamp.

In a preferred embodiment the reflective body of the lamella segment is an essentially U-shaped disc with a slot extending from the outer circumference to the central orifice, the projecting end of at least one of the legs of the U-shape having means for engaging it with a mounting brace. When the width of the slot has been adapted to the outer diameter of the rodlike lamp such lamella segments may be slid into position from below onto an already mounted lamp either individually or in a group. During this the slot in each segment is utilized for insertion and at least one leg but preferably both legs in the U-shape can be engaged onto a mounting brace which on one hand may serve to hold together and position several lamella segments and on the other hand may form part of means for suspending a glare protection made in this way.

In the preferred embodiment a part of the rim area of the reflective body is made integrally with a transverse element extending axially from at least one side of the reflective body. Preferrably the transverse element extends from both sides of the reflective body to provide a structure which is symmetrical around a main plane of the reflective body. Such transverse elements may be utilized as spacers to keep the reflective bodies to the desired relative spacing when the end face of the transverse element of the first reflective body abuts the next reflective body or the end face of a similar transverse element on the next reflective body. Further the transverse elements can advantageously constitute part of arrangements to connect the lamella segments with a mounting or carrying brace.

Figure 2:
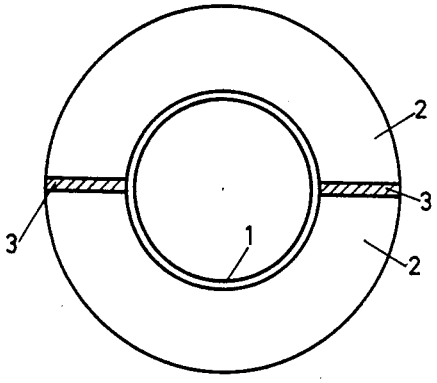
Figure 3:
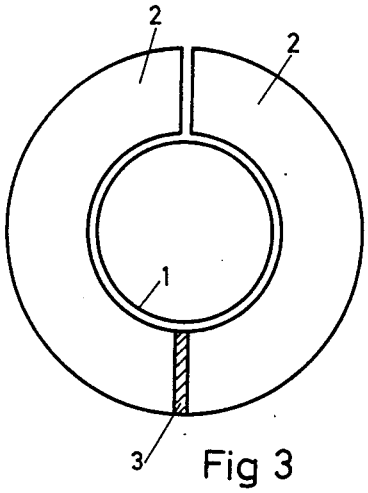
Figure 4:
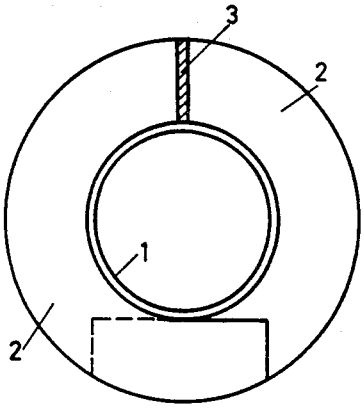
Figure 5:
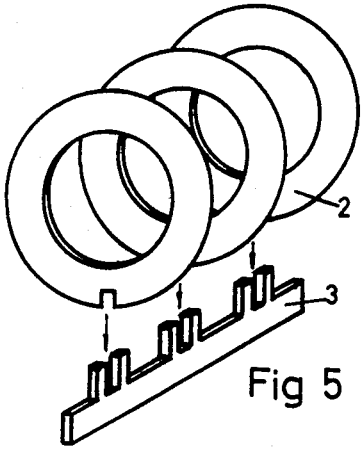
Figure 6:
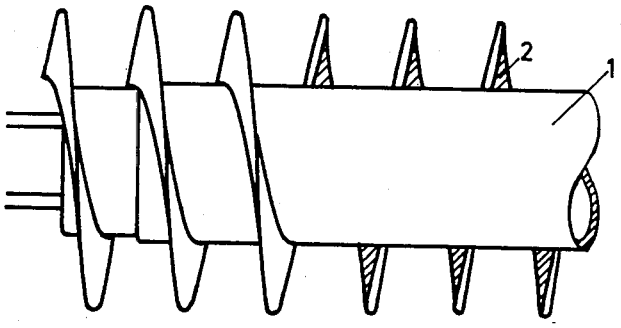
Figure 7:
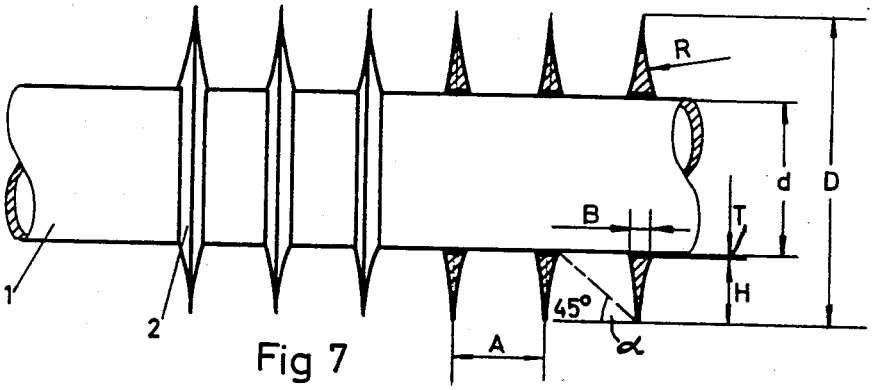
Figure 8:
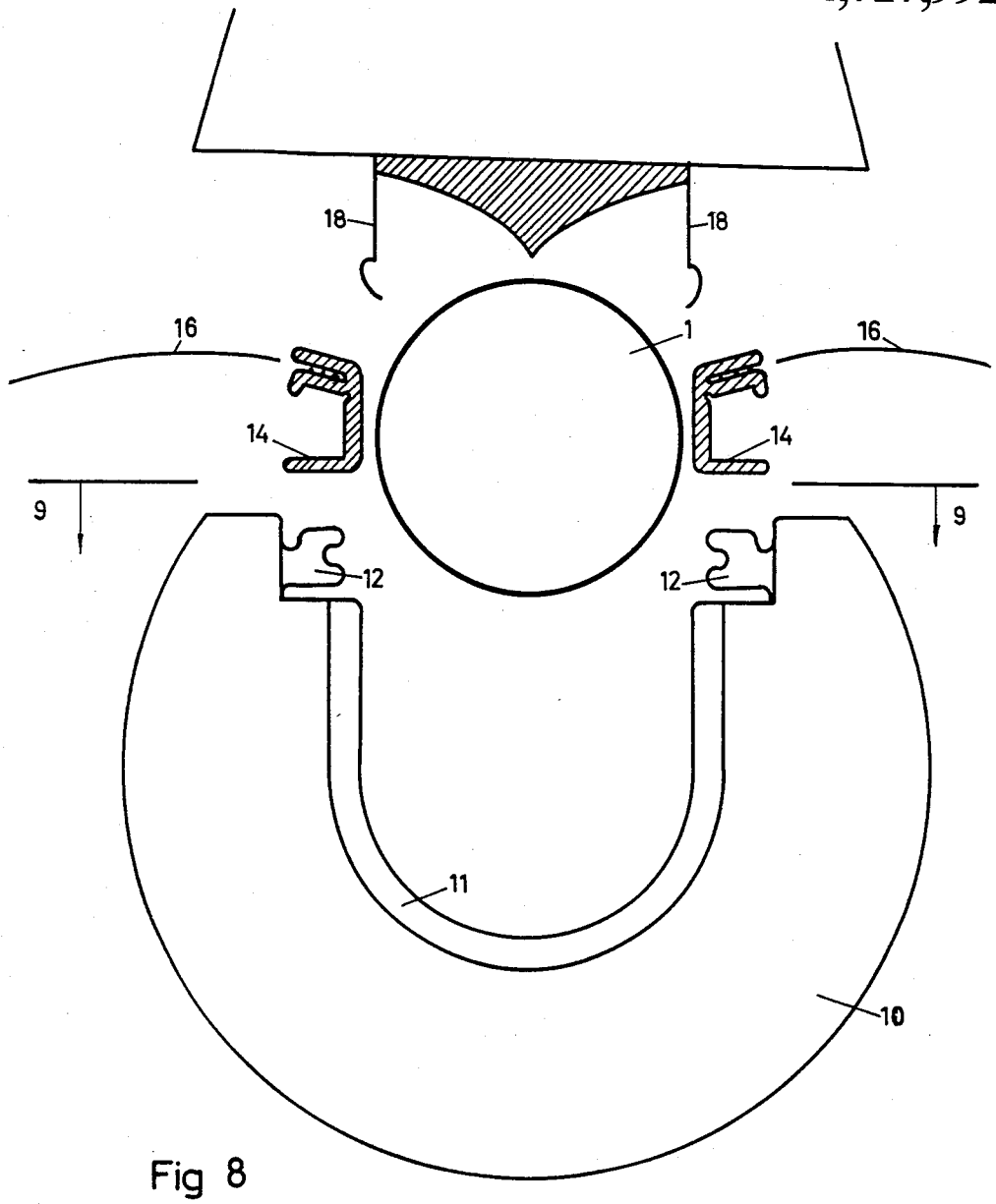
Figure 9:
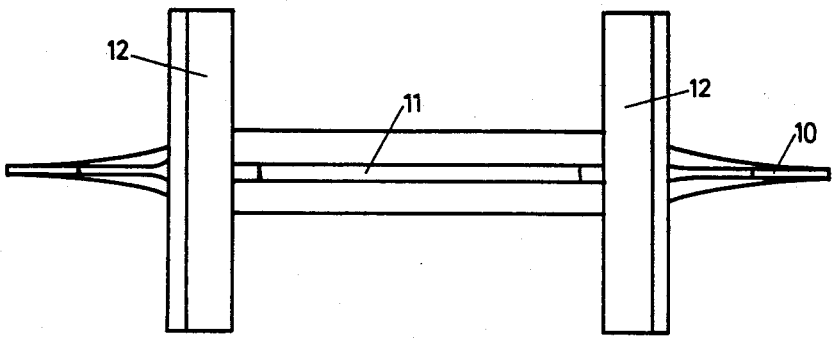
Figure 10:
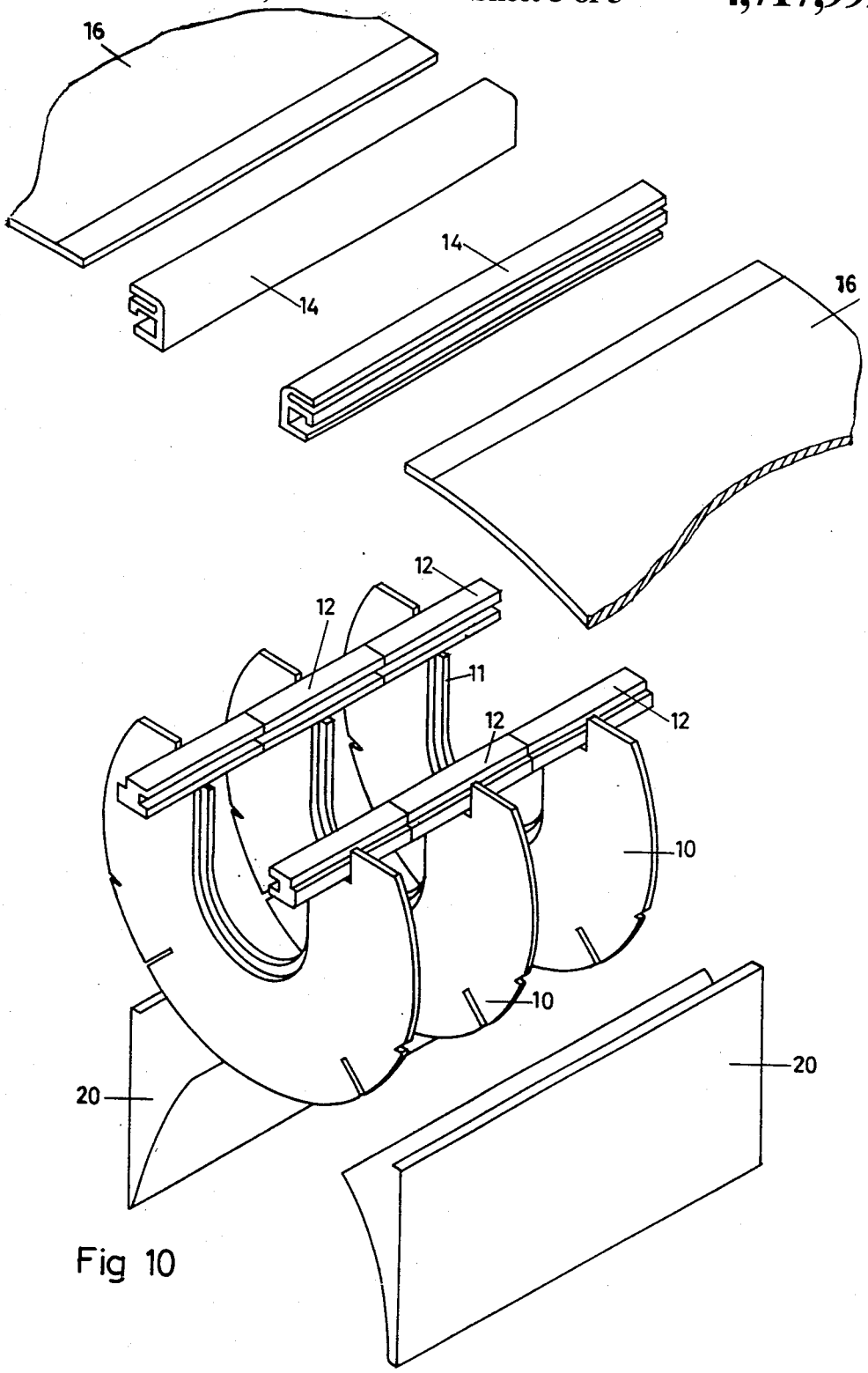

The invention will be decribed more detailed below with reference to the schematic drawings showing in:

FIG. 1 a part of a lamp with a glare protection according to the invention,

FIGS. 2–4 cross-sections through various embodiments of the arrangement shown in FIG. 1, FIG. 5 a further embodiment of the glare protection according to the invention in exploded view, FIG. 6 a fractional view partly in cross section showing a lamp with another embodiment of the glare protection according to the invention, FIG. 7 a fraction of a lamp fitted with applied single annular discs forming a glare protection according to the invention, FIG. 8 an exploded view showing a preferred embodiment of a lamella segment according to the invention with the associated mounting or carrying braces, FIG. 9 a planar view showing the lamella segment according to FIG. 8 along the direction 9—9, and FIG. 10 an exploded view in perspective showing the assembly of a glare protection made from lamella segments according to FIG. 8 or 9.

In all figures the cylindrical bulb of the rodlike lamp is indicated by the numeral 1 and lamella segments surrounding the lamp in the circumferential direction are indicated by the numeral 2.

The preferred geometric form and dimensioning of such lamellas appears from FIG. 7 in relation to the axial angle of cut off and to the diameter of the lamp 1. The symbols in FIG. 7 indicate:

$\alpha$—angle of cut off
A—lamella spacing
H—radial height of lamella
B—width of lamella base
d—diameter of lamp
T—tolerance
D—outer diameter of lamella As evident from FIG. 7 the outer diameter of the lamella D obeys the following relation:

$$D=d+2(H+T)$$

As it further appears from FIG. 7 the axial flanks of the lamellas 2 are concavely arched, the two axial flanks converging outwardly forming a tapered edge.

In a preferred embodiment the curvature is parabolic obeying the following relations:

$$H=A/2(1+\text{Cos}\ \alpha)\ \tan\alpha$$

$$B=A(1-\cos\alpha)$$

The curvature may also be approximated to a circular arc with radius R:

$$R = A\frac{\cos(\alpha/2)}{\cos(\alpha/2) - 1\frac{1}{2}}$$

$$H = (R - A)\sin\alpha,$$

$$B = 2[A - (R - A)\cos\alpha]$$

In the embodiment shown schematically in FIG. 7 the individual lamellas 2 consist of annular discs mounted onto the lamp 1 with the prescribed relative spacing and being pressed onto the lamp (in which case T=0) or glued onto the lamp.

However, the lamellas are preferably interconnected by means of longitudinally extending connecting members 3.

Preferred dimensions are:

$\alpha = 45°$ $D = 52$ mm and $A = 15$ mm

In the embodiment according to FIG. 1 the lamellas 2 comprise annular discs divided into halves, the halves being axially staggered and the halves being interconnected be means of a connecting member 3 extending in the axial direction of the lamp 1. The connecting member 3 and the lamellas 2 are interconnected to form an integral glare protection body preferably of a length of approximately 20 cm. Such glare protection bodies are preferably manufactured by injection moulding and have at their ends complementary connecting members by means of which the glare protection bodies can e connected to form an extended glare protection.

The respective lamella halves are staggered to permit an easier removal from the mould and a simpler construction of the injection mould.

FIGS. 2–4 show end pictures of various embodiments of glare protective bodies.

In the embodiment in FIG. 2 two longitudinally extending connecting members 3 are arranged opposite each other while in the embodiment in FIGS. 3 and 4 only one longitudinally extending connecting member is arranged. One end of the lamellas 2 forming semi annular discs are fitted onto the connecting member while the other end is freely suspended and an axial slot may be formed as can be seen in FIG. 3. This axial slot can serve to fix the orientation of the glare protection or its connecting member 3 as the slot may engage a corresponding projection. However the axial slot may also have such width that it may span any part of a luminaire construction extending so close to the lamp that no space is left to arrange lamellas between said luminaire construction and the adjacent lamp surface.

The projecting ends of the semi annular discs may, however, also overlap seen in the axial direction as shown in FIG. 4.

In FIG. 5 another embodiment of a glare protection body is shown whereby lamellas 2 are interconnected by means of a longitudinally extending connecting member 3. The lamellas 2 and the connecting member 3 in this embodiment are not formed integrally but are rather being manufactured separately, the lamellas and/or the connecting member having notches that may engage each other (the arrow in FIG. 5).

In FIG. 6 is shown the end of fluorescent tube 1 whereon is fitted a helically shaped lamella. The pitch of this helically shaped lamella corresponds to the distance A shown in relation to FIG. 7.

Alternatively to longitudinally extending connecting members such as the connecting member 3 in FIG. 5 each annular disc lamella 2 may also be made integrally with a transverse element extending from the outer circumference of the lamella away from the main plane of the lamella. Such transverse elements may be provided with means for connection either directly to transverse elements of adjacent segments or indirectly by connection to a mounting brace. The transverse elements may further be utilized as spacers to define the spacing between the lamellas.

FIGS. 8 and 9 show schematically a preferred embodiment of the lamella segment according to the invention. The lamella segment comprises an essentially plate or disc like reflective body 10, the outer circumference or contour hereof preferably being circular but possibly also in the shape of a parabola or the like. A central orifice or slot for insertion receives the lamp 1 when the lamella segment is put into place and this orifice or slot for insertion is defined by an edge 11 which should obscure the luminuous surface of the lamp to the minimum possible extent.

The reflective body 10 is essentially U-shaped and the projecting end of the leg of the U-shape has been provided with transverse elements 12 formed to be inserted in respective mounting braces 14 that may further be adapted to hold reflectors 16. With the segments being inserted into the braces 14 the thus assembled glare protection can be slid into position around the lamp 1 from below whereby e.g. resilient catching hooks 18 may snap onto the mounting braces and thus suspend the glare protection.

FIG. 10 illustrates in more detail the assembly of a glare protector with lamella segments according to the invention. The use of the cross pieces 12 as spacers to define the spacing between the lamella segments is especially to be seen. Further the circumference of the lamella segments has been provided with suitable notches which can receive longitudinally extended reflectors 20. The transverse elements 12 and the braces 14 may have other cross sections or profiles as necessary and a suitable elastic material may be used especially to the braces 14 making it possible to engage the transverse elements 12 herewith without it being necessary to slide the lamella segments of their transverse elements axially into the respective braces 14.

The reflective body 10 may have the form and the sizes referred to in relation with FIG. 7. Also other elements of the embodiments according to FIGS. 1–7 may be incorporated in or combined with the preferred embodiment according to FIGS. 8–10.

What is claimed is:

1. A glare protector for use with a rodlike lamp, such as a fluorescent tube, said glare protector acting in the longitudinal direction of the lamp and comprising reflective lamellas arranged adjacent to and around the surface of said rodlike lamp and forming axially spaced reflector surfaces extending generally radially outwardly from the surface of said lamp, said lamellas, when seen in profile section along an axial plane of the lamp, being in the shape of a narrow wedge with a tip of the wedge pointing away from the lamp and with the wedge having concave flanks, said glare protector being mountable to said lamp.

2. The glare protector according to claim 1 wherein said lamellas are shaped in such manner that the wedge shaped-part does not extend right up to the surface of the lamp but is held with a spacing therefrom by means of a thin rim or by some other holding means arranged so as not to obscure unduly the luminous surface of the lamp.

3. The glare protector according to claim 1 wherein said lamellas are in the form of annular discs entirely or partly embracing said lamp.

4. The glare protector according to claim 3 wherein said annular discs are interconnected by means of an attached longitudinally extending connecting member.

5. The glare protector according to claim 1 wherein said lamellas comprise at least and preferably one helix placed on the lamp and with a flat extending cross section perpendicular to the axis of the lamp.

6. The glare protector according to claim 1 wherein said lamellas comprise half annular discs which are staggered in the longitudinal direction of the lamp and wherein at least a number of lamellas are integrally connected with at least one connecting member extending along the lamp.

7. The glare protector according to claim 1 wherein said lamellas are suspended by the lamp and generally surround the lamp circumferentially, practically without distance from the lamp.

8. A lamella segment for use in a glare protector according to claim 1 comprising a generally plate or disc shaped refletive body preferably of circular circumference and with a central orifice for receiving or locating the rodlike lamp.

9. The lamella segment according to claim 8 wherein the reflective body is a generally U-shaped disc with a slot extending from the outer circumference to the central orifice and wherein the projecting end of at least one of the legs of the U-shaped disc has means for engagement with a mounting brace.

10. The lamella segment according to claim 9 wherein a part of the rim areas of the reflective body are made integrally with a transverse element extending axially from at least one side of the reflective body.

11. Luminaire with a rodlike lamp such as a fluorescent tube and with a glare protector mounted on said lamp and acting in the longitudinal direction of the lamp and comprising wedge shaped reflective lamellas arranged along the surface of said rodlike lamp and forming axially spaced reflector surfaces extending generally radially outward from the surface of said lamp and further including a glare protector acting in the transverse direction of the lamp and comprising reflective bodies extending longitudinally relative to the lamp and complementary reflective bodies preferably being fitted directly onto the lamellas.

12. Luminaire with a rodlike lamp such as a fluorescent tube and with a glare protector acting in the longitudinal direction of the lamp and comprising reflective lamellas said lamellas being arranged along the surface of said rodlike lamp and forming axially spaced reflector surfaces extending generally radially outward from the surface and by the lamella profile as seen in section along an axial plane of the lamp being in the shape of a narrow wedge the tip of which is pointing away from the lamp, preferably having concave flanks and said lamellas comprising half annular discs which are staggered in the longitudinal direction of the lamp and at least a number of lamellas being integrally connected with at least one connecting member extending along the lamp.

13. Luminaire with a rodlike lamp such as a fluorescent tube and with a glare protector acting in the longitudinal direction of the lamp and comprising reflective lamellas, said lamellas being arranged along the surface of said rodlike lamp and forming axially spaced reflector surfaces extending generally radially outward from the surface and having a profile in section along an axial plane of the lamp in the shape of a narrow wedge the tip of which is pointing away from the lamp and preferably having concave flanks.

14. Luminaire with a rodlike lamp such as a fluorescent tube and with a glare protector mounted on said lamp and acting in the longitudinal direction of the lamp and comprising wedge shaped reflective lamellas arranged along the surface of said rodlike lamp and forming axially spaced reflector surfaces extending generally radially outwrd from the surface of said lamp and further including a glare protector acting in the transverse direction of the lamp and comprising reflective bodies extending longitudinally relative to the lamp.

* * * * *